United States Patent [19]

Haner

[11] 4,166,991

[45] Sep. 4, 1979

[54] SOLENOID

[75] Inventor: Lambert Haner, Rocky River, Ohio

[73] Assignee: Acme-Cleveland Development Company, Highland Heights, Ohio

[21] Appl. No.: 843,728

[22] Filed: Oct. 19, 1977

[51] Int. Cl.[2] ..... H01F 3/00

[52] U.S. Cl. ..... 335/261; 335/255

[58] Field of Search ..... 335/261, 255, 258, 249

[56] References Cited

U.S. PATENT DOCUMENTS

| | | | |
|---|---|---|---|
| 2,114,961 | 4/1938 | Gille | 335/249 |
| 2,407,603 | 9/1946 | Derungs | 335/261 |
| 2,407,963 | 9/1946 | Persons | 335/261 |
| 3,168,242 | 2/1965 | Diener | 335/261 |
| 3,381,250 | 4/1968 | Weathers | 335/255 |
| 3,505,628 | 4/1970 | Allen | 335/255 |
| 3,805,204 | 4/1974 | Petersen | 335/258 |

*Primary Examiner*—Harold Broome

*Attorney, Agent, or Firm*—Pearne, Gordon, Sessions, McCoy & Granger

[57] ABSTRACT

A solenoid operable from an alternating voltage source is disclosed and the solenoid may actuate a fluid valve with the fluid of the valve wetting the movable armature inside a barrel. The barrel is sealed against fluid leakage at all places except the axial end connected to the valve. A frame is coaxial with the barrel and encloses an electrical coil. A magnetically permeable core is inside the barrel and fixed relative to the frame and this core carries a first pole piece. A second pole piece is on the movable armature for cooperation with the first pole piece. The electrical coil is energized with rectified voltage from the alternating voltage source and this together with the shape of the pole pieces establishes a controlledsaturation of these pole pieces in a range of positions of the armature. This saturation of the pole pieces is established so that the saturation decreases as the armature moves from a first extended position toward a second closed position. This changeable saturation of the pole pieces permits the stroke versus force curve of the solenoid to be improved in comparison to the prior art.

26 Claims, 13 Drawing Figures

SOLENOID

BACKGROUND OF THE INVENTION

The typical prior art solenoid is one which controls the movement of the armature and obtains a force to move the armature by establishing an air gap which is changed. In most of the prior art solenoids the two pole pieces are flat and perpendicular to the path of movement of the armature. This is shown in U.S. Pat. No. 1,217,141 for example. In some prior art patents such as U.S. Pat. No. 750,132 the cooperating pole pieces are each tapered and this is primarily for the purpose of obtaining an air gap, for a given length of stroke, which is shortened proportional to the sine of the angle of the taper. This increases the force at the extended position of the armature. Rotary solenoids such as that shown in U.S. Pat. No. Re. 22,902 also utilize a tapered pole piece or a tapering amount of iron in the coal in order to achieve a pull on the armature tending to move the armature into the coil to a position whereat the greatest amount of iron is inside the coil.

Another form of the prior art is one wherein the armature may move beyond the axial center of the coil. This type is shown in U.S. Pat. No. 3,139,565 and the frame of the coil may have a magnetically permeable fixed pole piece extending axially part way into the bore of the coil. This axial extension is intended to carry all of the flux established by the coil.

Another prior art structure is suggested by U.S. Pat. No. 2,829,319 to have an armature with a hollow ellipsoid in the end so as to have, in effect, a tapering pole piece on the armature. This patent, however, specifically teaches that the flux established both by an electrical coil and a permanent magnet should be sufficiently low so that the pole piece is not saturated. Another prior art construction with a tapered pole tip is that shown in *Control Engineering,* November, 1974 at page 53. Such construction, however, effectively had both pole pieces on the stationary frame for a flux path therebetween and the cylindrical armature was movable to provide a second flux path from one pole piece to the other. The shaped pole piece was claimed to establish the armature position proportional to the input current rather than the usual function of a solenoid to be energized and to move quickly from an extended to a seated position. Still other prior art constructions were as shown in U.S. Pat. No. 2,357,959 wherein triangular magnetically permeable pieces were disposed in the air gap to be effectively in parallel with the flux between the pole pieces in the closed position of the armature. These were stated to provide an opposite or negative component to the force developed on the armature so as to reduce the acceleration of the armature and prolong the time delayed action of the solenoid.

The prior art solenoids have been ones wherein a DC operated solenoid is usually two to three times the volume of an AC operated solenoid for the same sealed force, so that in many cases an AC solenoid was used to save space even though these required shading coils or the like to avoid objectionable hum, and also required laminated silicon steel to avoid eddy current losses. The prior art AC solenoids often were made two to three times smaller than the DC solenoids for the same seated force, because they relied on the large inductive reactance of the AC coil, when the armature was seated, to limit the coil current. However, this usually meant that the AC solenoids were subject to having the electrical coil burn out if the armature of the solenoid were somehow prevented from seating within a very short time after the coil was energized. The typical prior art AC solenoid with a variable air gap was one which had a force versus stroke curve which was essentially an inverse square curve with the force increasing greatly just before the armature seated by engagement of the two pole pieces. This meant that a majority of the energy at this portion of the stroke is greatly in excess of the energy requirement of the attached working load. This large excess energy was absorbed by the mass of the load as kinetic energy and was dissipated in the destructive hammer blow shock occurring when the solenoid armature seated. Accordingly, the problem to be solved is how to construct a solenoid which avoids this large self-destructive hammer blow shock and makes the stroke versus force curve of the solenoid one which more closely approximates the stroke versus force requirements of the attached working load.

SUMMARY OF THE INVENTION

This problem is solved by a solenoid comprising, in combination, a magnetically permeable frame means having an axis, a magnetically permeable movable armature coaxially disposed relative to said axis, first pole piece means on said frame means, second pole piece means on said armature cooperable with said first pole piece means, said armature having a first extended position with said first and second pole piece means separated from each other and having a second position with said first and second pole piece means relatively close together, and magnetic field saturation means to saturate a flux carrying area of one of said pole piece means in some segment of the range of positions of said armature.

Accordingly, an object of the invention is to provide a solenoid constructed so as to have controlled saturation of a pole piece during movement of the armature.

Another object of the invention is to provide a solenoid wherein the stroke versus force curve of the solenoid more closely approximates the stroke versus force curve of the attached working load so that the solenoid may be made smaller for a given load application and thus constructed at lower cost.

Another object of the invention is to provide a solenoid with a stroke versus force curve which is broader at the base to minimize the hammer blow upon seating of the pole pieces.

Another object of the invention is to provide a solenoid with a cost advantage or a performance advantage or both.

Another object of the invention is to provide a solenoid which may have a majority of the cross sections circular for economical fabrication by machining, casting or powder metallurgy.

Another object of the invention is to provide a solenoid wherein the electrical coil will not burn out if the armature does not seat and one which does not require any shading coil nor does it require a non-magnetic tube in which the armature slides.

Another object of the invention is to provide a solenoid which will operate on either 50 or 60 Hz with no variance in performance.

Another object of the invention is to provide a solenoid wherein the force developed by the armature is proportional to the applied voltage rather than to the square of the applied voltage so that the force varies less with changing applied voltage.

Another object of the invention is to provide a solenoid in which a metal having a higher saturation level may be utilized in order to increase the force of the solenoid.

Other objects and a fuller understanding of the invention may be had by referring to the following description and claims, taken in conjunction with the accompanying drawing.

DESCRIPTION OF THE PREFERRED ENBODIMENTS

Figure 1:
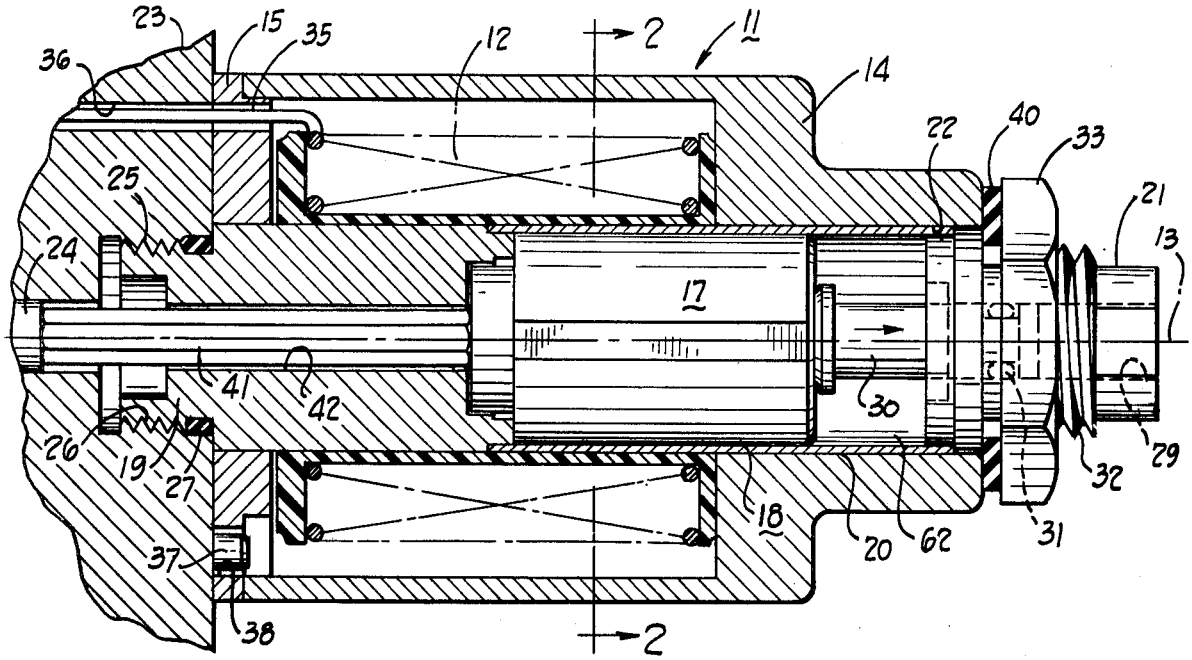
FIG. 1 is an enlarged longitudinal sectional view of a solenoid embodying the invention.
Figure 2:
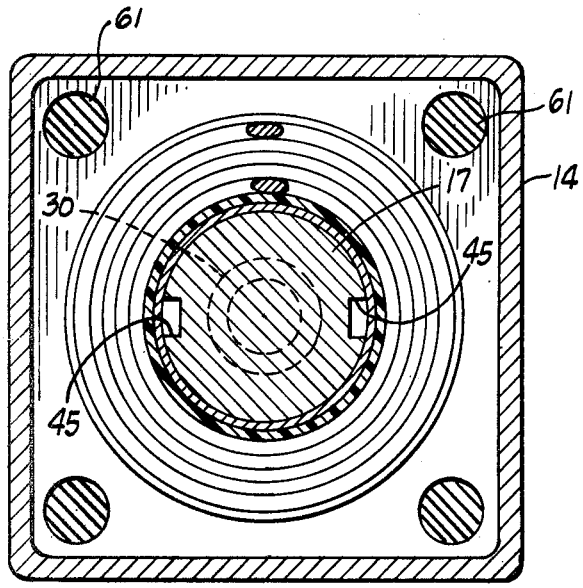
FIG. 2 is a cross sectional view on line 2—2 of FIG. 1.
Figure 3:
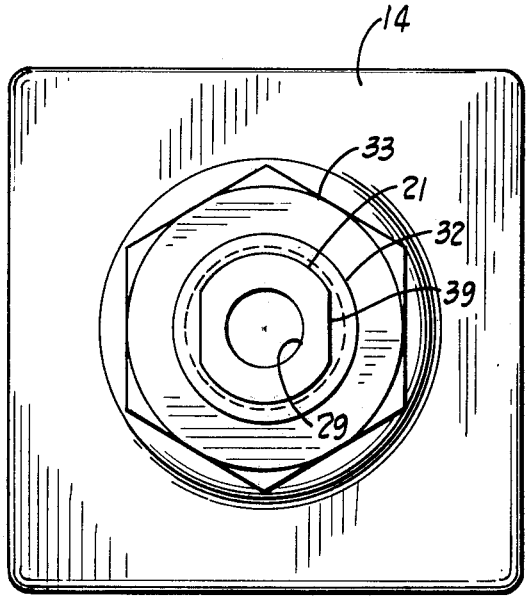
FIG. 3 is an end elevational view of the solenoid of FIG. 1.

FIGS. 1–4 illustrate a first embodiment of the invention which is a solenoid 11 having an electrical coil 12 with an axis 13. A magnetically permeable frame 14 carries magnetic flux around the outside of the coil 12 and this frame preferably is coaxial with the coil 12. The frame 14 also preferably acts as a housing to enclose and protect the parts of the solenoid 11. An end plate 15 is magnetically permeable and forms a part of the frame 14. It is secured, as by an adhesive, to the open end of the frame 14.

A movable armature 17 is provided for coaxial movement within the solenoid. The armature 17 moves inside of a barrel 18 and the barrel includes generally three different parts, a magnetically permeable core 19, a sleeve 20 and an end cap 21. In this embodiment the sleeve 20 is sealed to each of the core 19 and end cap 21. This sealing may be by any of several ways such as O-rings or soldering, but in this embodiment it is sealed to it and secured to it by welds 22. This makes the barrel an integral assembly for easy handling. The solenoid 11 may be used with many different applied loads, but as shown, the solenoid 11 is secured to a valve 23 to actuate the valve rod 24. The solenoid 11 may be secured in many different ways to the valve 23, but as shown the core 19 has a threaded extension 25 threaded into a tapped structure 26 in the valve 23. An O-ring 27 seals the barrel 18 to the valve 23 and thus the barrel 18, being sealed at all locations except the axial end containing the threaded extension 25, will seal within this barrel 18 the fluid of the valve 23.

The end cap 21 has a coaxial aperture 29 which receives a coaxially slidable manual push pin 30. The pin 30 is sealed to the end cap 21 by an O-ring 31. The end cap 21 has male threads 32 receiving a nut 33 which acts against the outer end of the housing or frame 14 to secure the entire solenoid 11 to the valve 23.

The electrical coil 12 has conductors 35 for energization and these conductors may pass through an aperture 36 in the valve 23 for physical protection to the conductors and to lead to a junction box for electrical energization. A locator pin 37 may be provided on a valve 23 and be received in a locator aperture 38 in the end plate 15. In assembly of the solenoid 11 to the valve 23, first the barrel 18 may be threaded at 25 into the tapped aperture 26 and tightened in place by a wrench on the wrench pads 39. Next the solenoid frame 14 carrying the coil 12 may be placed coaxially over the barrel 18 with the conductors 35 threaded through the aperture 36 until the end plate 15 seats against the outer face of the valve 23. The locator pin 37 will fit within the locator aperture 38 to prevent rotation of the solenoid frame 14, to thus protect the conductors 35. A washer 40 may be placed over the end of the barrel 18 and then the nut 33 screwed on the threads 32 to secure the entire solenoid 11 to the valve 23.

The solenoid 11 is connected in some manner to actuate the applied load. The armature may pull on the load to actuate it, but in this embodiment shown, a hexagonal push pin 41 extends through a coaxial aperture 42 of the core 19 to act on the valve rod 24 and be cooperable with the armature 17.

The armature 17 fits closely within the inner bore of the sleeve 20, except the longitudinal passageways 45 are provided so that the fluid of the valve 23 may pass freely from one end of the armature to the other to permit free movement of the wetted armature 17. If these passageways 45 were not provided then there could be a dashpot or damping effect on the movement of this armature 17.

First pole piece means 48 is provided on the frame 14 and second pole piece means 49 is provided on the armature 17. Each of these pole piece means is circular in cross section to provide ease of manufacture by machining, casting or powder metallurgy. The second pole piece means 49 includes a flat circular annular face 50 plus a central coaxial cylindrical extension 51 on the armature 17. This cylindrical extension has a flat circular face 52. The annular face 50 is circular except for the longitudinal passageways 45 which may be flats on the cylindrical surface or, as shown, are longitudinal slots.

The first pole piece means 48 is generally complementary to the second pole piece means 49 and includes an annular flat face 53 having an annular inner shoulder 54 and a second annular inner shoulder 55 formed by first and second counterbores 56 and 57, respectively. The end of the counterbore 57 is established by a flat circular face 58 which is interrupted at the center by the coaxial aperture 42.

The electrical coil 12 may be energized by direct current but also the solenoid may be energized with alternating current and this fed to the coil 12 through from 1 to 4 rectifiers 61 which may be mounted in the inner corners of the square cross-section frame 14. This provides DC energization of the coil 12.

OPERATION

Figure 4:
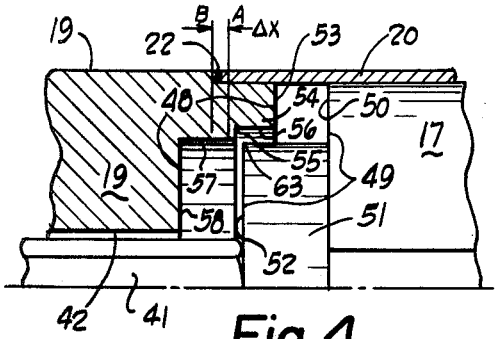
FIG. 4 is an enlarged partial longitudinal sectional view, similar to FIG. 1, but with the armature in a different position.

FIG. 1 illustrates the armature 17 in the second or seated position and FIG. 4 illustrates the armature in a partially closed position. The first or open position would be with the armature moved completely to the right until the armature engages the end cap 21. The push pin 30 would usually be in the rightmost position, but is shown extended to the left, as in manual operation. The pole pieces 48 and 49 may be so proportioned in length that face 52 engages face 58 rather than faces 50 and 53 engaging, but in this preferred embodiment faces 50 and 53 engage while there still remains a slight space between the faces 52 and 58 in order to permit a passageway for the fluid from the aperture 42 to proceed to the longitudinal passageways 45. This permits the volume 62 to be filled with fluid as the armature 17 moves from the first to the second position.

The first portion of this closing movement from the first or extended position to the position of FIG. 4 is one wherein the force on the armature 17 is established by a variable air gap between the pole pieces 48 and 49. However, the segment of the range of positions of the armature 17 from the position of FIG. 4 to the seated position of FIG. 1 will be one of variable saturation of a flux carrying area of one of the pole pieces. The coil 12 plus the shape of the pole pieces 48 and 49 establishes a magnetic field saturation means. This saturates a flux carrying area of one of the pole pieces, illustrated as the annular shoulder 55 on the pole piece 48 and concurrently an annular shoulder 63 at the outer periphery of the cylindrical extension 51 on pole piece 49. These two shoulders are closely adjacent at this position being only a few thousandths of an inch apart. In one practical embodiment constructed in accordance with FIGS. 1 to 4 the radial spacing between these two shoulders was in the range of 7 to 11 thousandths of an inch. This close spacing of these shoulders results in a flux saturation of the metal of these areas.

Now assume that the force on the armature 17 moves this armature to the left an increment, e.g. 0.010 inches. The flux carrying areas of the shoulders 55 and 63 would then overlap slightly to provide a slightly better flux carrying path and the flux lines would spread out over a larger flux carrying area. This would still be a saturated flux carrying area on both the shoulders 55 and 63. The spreading out of the lines of force, however, would result in a slightly lower degree of saturation, and it is this decrease in saturation level which establishes the continued leftward force on the armature 17. The present solenoid utilizes the magnetic saturation of the iron to control the force curve.

Fundamentally, any solenoid functions, via an electromagnetic field, to convert electrical energy into mechanical energy. In the preponderant majority of applications the prior art solenoid was "overpowered" or "oversized". This meant that the mechanical energy it could produce significantly exceeded the energy requirement of the attached working load. This large excess was absorbed by the mass of the load as kinetic energy and is dissipated in the hammer blow shock occuring when the solenoid armature seated. The reason, simply, was that the typical prior art solenoid design produced an armature force vs. stroke characteristic which somewhat follows an inverse square function of force vs. displacement, see curve 66 in FIG. 13 as a typical prior art curve. A usual load requires a nearly constant or mildly increasing force as the armature moves towards the seated position, see curve 67 in FIG. 13.

The present invention establishes a solenoid which more closely matches the total mechanical energy produced by the solenoid to the total mechanical energy required by the load, and results in:

1. Producing a comparatively smaller sized solenoid, hence lowering cost.
2. Minimizing hammer block shock effects.
3. Permitting use of a solenoid with a DC energized coil in a size of a prior art AC solenoid.

The following explanation helps to explain the difference between the prior art system of a variable air gap solenoid and a solenoid of the present invention which utilizes variable saturation.

The total amount of mechanical energy that a solenoid can produce is related to certain electromagnetic parameters as:

$$\text{Mechanical energy} = U = \tfrac{1}{2} N\phi i \times 10^{-8} \text{ joules}$$

where

N = total number of turns in the coil $\phi$ = total amount of flux linking the coil expressed in cgs units of maxwells (or lines)

i = coil current in amperes

Since the mechanical force vs. stroke curves are presented in units of pounds and inches respectively, then it is more convenient to express energy in terms of inch-pounds as:

$$U = 4.42 N\phi i \times 10^{-8} \text{ inch-pounds} \quad (1)$$

The specific force that the solenoid produces at any specific position of the armature is merely the incremental change in energy divided by the corresponding incremental change in armature position. Expressed another way: The force at any specific armature position is equal to the derivative of energy with respect to distance.

For a classical prior art solenoid with a flat faced armature and a variable air gap, it is possible to derive a force formula that relates force to electromagnetic and mechanical parameters. This derivation assumes that most of the electromagnetic energy is stored in the air gap. (Note: The electrical energy taken from the electrical power source is equal to $N\phi i \times 10^{-8}$ joules. Exactly half of this energy ($\frac{1}{2}N\phi i \times 10^{8}$ joules) is stored in the solenoid field as electromagnetic energy and the other half is converted into mechanical energy to move the armature. Therefore, the change in field energy as a function of change in armature position at any position is the same as the change in mechanical energy).

Expressing the length of the air gap as lg, the field gradient (or magnetizing force) can be expressed as:

$$H = (0.4\pi Ni)/lg$$

where

H = oersteds

N = number of coil turns lg = gap length in centimeters i = coil current in amperes Rearranging, $$Ni = 2lgH$$

where lg is in units of inches, the flux in the air gap, designated as $\phi$, can be expressed as:

$$\phi = \beta a$$

where $\beta$ = flux density in gauss, a = area in square centimeters, and $\phi$ = maxwells or $\phi = 6.45\beta A$, where A=area in square inches.

Now by substituting, $Ni=2lgH$, and $\phi=6.45\beta A$ into the original energy equation (1) yields the following:

$$U=(2)(6.45)(4.42)\cdot lg\cdot H\cdot\beta A\ 10^{-8}\text{ inch/pounds} \quad (2)$$

Since in air $\beta=\mu H$, where $\mu=1$ then $\beta=H$, hence, $$U = (2)\ (6.45)\ (4.42)\cdot lg\ \beta^2\cdot A\cdot 10^{-8}\text{ inch/pounds} \quad (3)$$

$$\text{or}\quad U=\frac{1g\ \beta^2 A}{1.76\times 10^6}\text{ inch/pounds}$$

The force relationship of a prior art variable air gap solenoid is then derived by differentiating U with respect to lg, hence:

$$\text{Force} = F = \frac{d\ U}{d\ lg} = \frac{\beta^2 A}{1.76\times 10^6}\text{ pounds,} \quad (4)$$

where $\beta$=flux density in gauss, and

A=armature cross sectional area in square inches.

In a solenoid of classical design, it is a practical necessity that the tube with which the armature resides be non-magnetic in the region where the air gap between the armature and the armature seat exists. The reason for this is primarily: In a classical AC solenoid, the force at the retracted position is higher than it would be if it were a DC solenoid because the inductive reactance is used to advantage. When the armature is seated, the inductive reactance is higher and therefore limits the current in the coil. However, when the armature is retracted the inductive reactance is reduced greatly and the current in the coil may be six times the level when the armature is seated. This increase in current will, of course, create a corresponding increase in force. If the tube were magnetic, the reactance would be higher, hence the current lower in the retracted position. The only way that the force could be raised would be to make the coil larger, i.e., more ampere turns.

To convert in terms of air gap length lg, since:

$\beta=\mu H$ $\mu=1$ for air hence, $\beta=H$

Also $H=Ni/2lg=\beta$ substituting for $\beta$ in (4) above $$\text{Force} = \frac{(Ni)^2 A}{(4)\ (1.76\times 10^6)lg^2} \quad (5)$$

One can see from equation (5) that the force is inversely proportional to the square of the air gap. This analytically correlates with the observed inverse square curve of the typical air gap solenoid, curve 66 on FIG. 13.

The key to the phenomenon of electrical to mechanical energy conversion is Faraday's discovery and Lenz's Law, i.e., if the flux linking a coil changes, then a voltage is induced in the coil. It is the current flowing in the coil multiplied by this induced voltage that represents the energy taken from the electrical power source for electro-mechanical conversion. In a solenoid, one half of this energy is stored in the magnetic field and the other half is converted to mechanical energy; namely, armature.

The key to the generation of the force curve is the change in energy that occurs for an incremental change in armature position at any given position of the armature.

In the prior art variable air gap solenoid, the force curve is determined by the variable air gap itself. To change the shape of the force curve as a function of armature position, it is necessary to find a means to control the change in energy as a function of armature position. The energy equation is given by equation (1):

$$\text{Energy}=U=4.42N\phi i\times 10^{-8}\text{ inch-pounds}$$

In a solenoid, the number of turns are constant, also the steady state current is constant. The only term remaining which may be varied is the flux $\phi$.

Since the energy and flux are linearly related in the energy equation, one can think of controlling the force curve by finding a means to control the change in flux as a function of armature position.

Magnetic materials have a high permeability relative to air. That is, the flux created in a magnetic circuit by a given field gradient is much greater in magnetic material such as iron than in air. But this is only true up to a certain level of flux density and then the material "saturates". By using this saturation characteristic, the present invention makes it possible to control the change in flux as a function of armature position by shaping the magnetic circuit geometry.

The flux flows through the iron magnetic circuit and passes through the saturated annular shoulders 55 and 63, designated as area "A" on shoulder 55. The area of these saturated shoulders is much smaller than the cross-sectional area through the armature 17, core 19 or frame 14. The coil 12 is energized with current and the ampere turns are established large enough to force area "A" of the shoulders 55 and 63 well into saturation. The flux in the circuit is therefore the area "A" multiplied by the flux density of saturation, $B^1$ sat. The flux is then:

$$\phi A=B^1\text{ sat}\cdot\text{Area "A"}$$

If the armature is allowed to move a distance $\Delta X$, then the flux is controlled by area "B" in saturation. This new flux is:

$$\phi B=B^1\text{ sat}\cdot\text{Area "B"}$$

The force created by the armature is then equal to the change in flux divided by the incremental change in distance $\Delta X$ or:

$$\text{Force}=(\phi B-\phi A)/\Delta X \quad (6)$$

Curve 66 shows the typical inverse square curve of the prior art solenoid with a flat face and a variable air gap in order to develop the force on the armature. Curve 67 is the stroke vs. force curve required for a typical valve 23. Curve 68 is a curve of the same prior art solenoid as that for curve 66 except the solenoid has been energized with 15 percent less than rated voltage; namely, 98 volts AC instead of 115 volts AC. This is typical of the permissible voltage range in commercial power systems. In such case one will note that the force developed has been decreased about 28 percent which illustrates graphically how the force is proportional to the square of the current rather than merely to the current.

Figure 13:
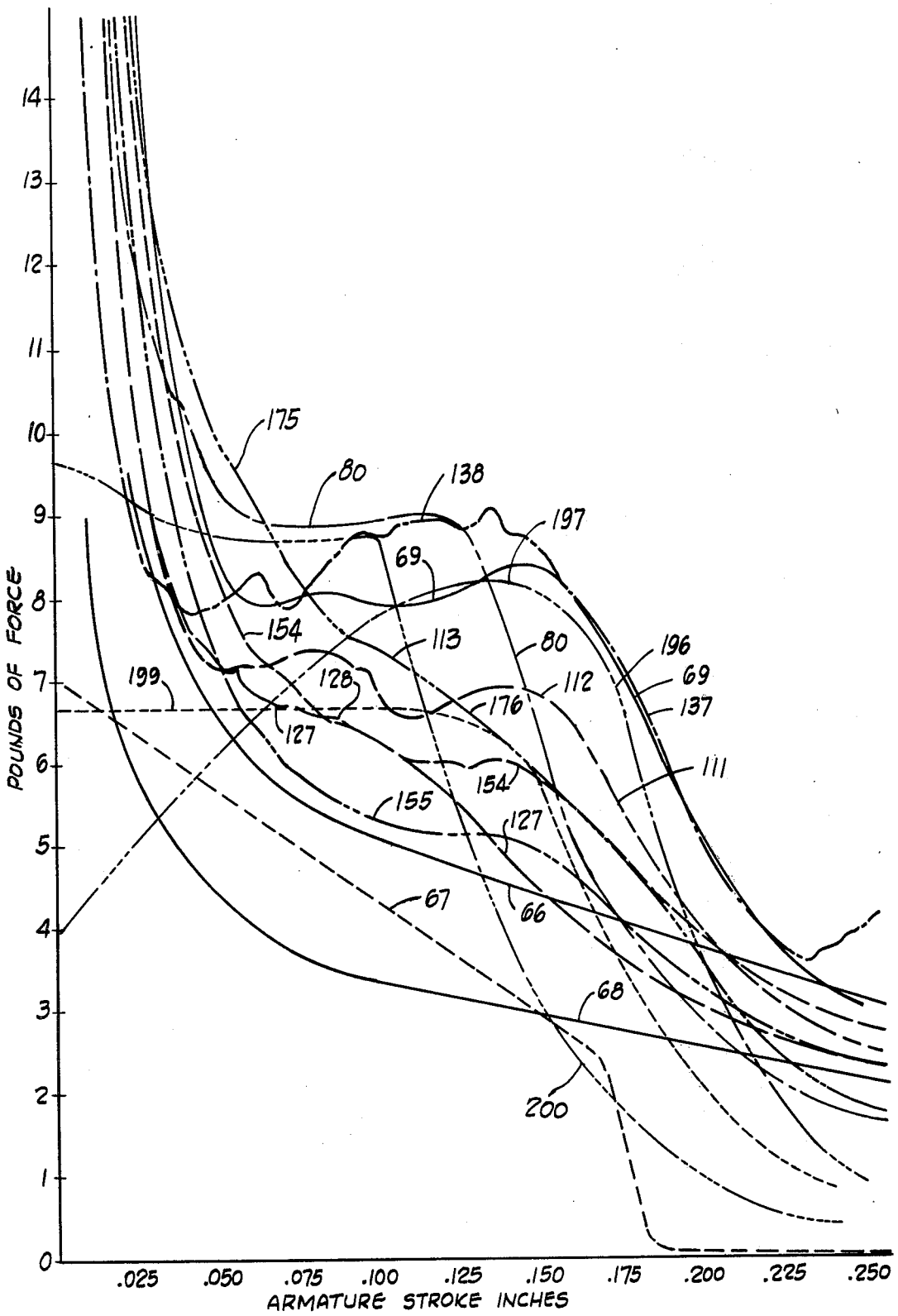
FIG. 13 is a graph of stroke versus force curves of the various embodiments of the invention.

Curve 69 on FIG. 13 illustrates the stroke vs. force curve of the solenoid 11 of FIGS. 1–4. This shows that the force exceeds the load curve 67 of the valve 23.

Figure 5:
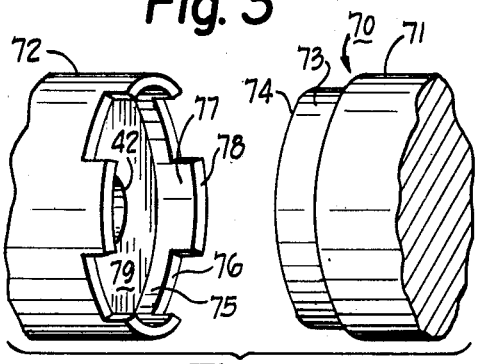
FIG. 5 is a partial isometric view of the pole pieces of a further modification.

FIG. 5 shows a modified solenoid 70 of the invention wherein an armature 71 cooperates with a core 72. This armature and core may be sutstituted for the armature 17 and core 19 of FIGS. 1–4 and the air gap will thus be generally at the longitudinal center of the coil 12. The armature 71 has a cylindrical extension 73 with an annular shoulder 74 at a flat face, not shown, but at the forward end of the armature 71.

The core 72 has a coaxial sleeve extension 75 with this sleeve cut away or relieved at arcuate shoulders 76 in order to form a plurality of longitudinally extending portions which in turn have arcuate shoulders 78. A face 79 on the core 72 cooperates with the flat face on the end of the armature 71 and may act as a stop or alternatively the arcuate shoulders 78 may abut the shoulder at the base of the cylindrical extension 73 when the armature is in the second or closed position.

In operation, the armature moves forwardly when the coil is excited. When it has moved far enough the cylindrical extension 73 fits closely within the coaxial sleeve extension 75 and there will be saturation at the annular shoulder 74 in four localized areas radially opposite the arcuate shoulders 78 on the longitudinally extending portions 77. These arcuate shoulders 78 will also be saturated. As the armature moves forward another increment of distance, there will be more overlap of the cylindrical extension 73 and the extending portions 77 so that the flux carrying area will increase and the saturation will decrease. It is this change of or decrease in saturation which establishes the force urging the armature forwardly toward the second or closed position. When the armature has moved sufficiently to have the annular shoulder 74 adjacent the arcuate shoulders 76, then the total area of iron carrying the flux will be increased to again decrease the level of saturation in a stepwise fashion. Curve 80 on FIG. 13 shows the operational curve for this form of solenoid core and armature.

Figure 6:
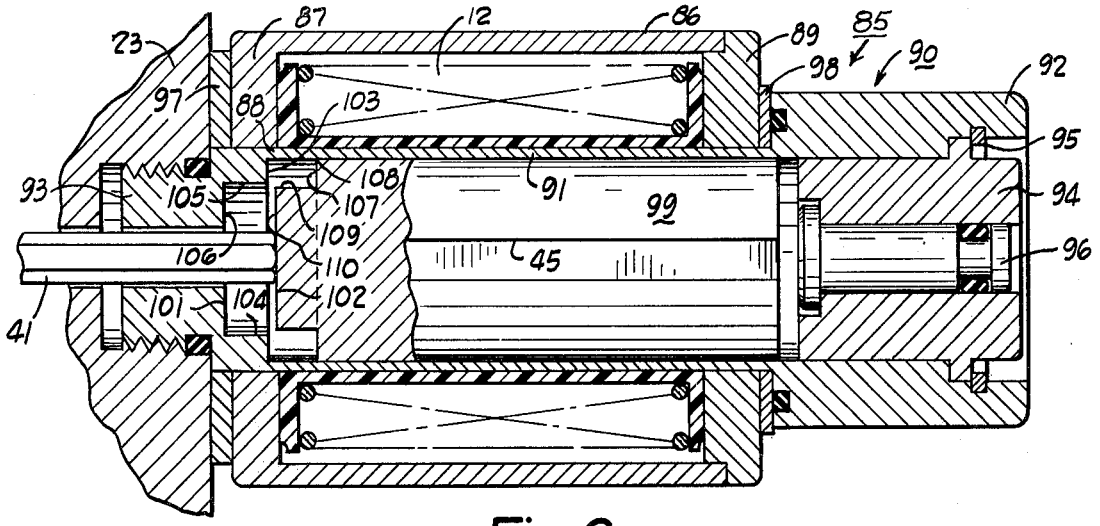
FIGS. 6, 7, 8 and 9 are partial longitudinal sectional views of still further modifications.

FIG. 6 illustrates a solenoid 85 which may be similar to the solenoid of FIGS. 1–4 in many respects. The coil 12 is utilized but the frame 86 is somewhat different having a unitary end plate 87 with an annular shoulder 88. A cap 89 is another part of the frame and all of this frame is magnetically permeable. In this construction the barrel 90 includes a sleeve 91 integral with a cap 92 at the outer end of the barrel and a core 93 at the inner end thereof. The sleeve may be unitary with the cap 92 and core 93 or this may be an integrated unit created by soldering or welding the parts together as in the embodiment of FIG. 1. An insert 94 is held in coaxial aperture in the cap 92 by a snap ring 95 and this insert 94 carries a manual push pin 96. The end plate 87 is spaced from the valve 23 by a washer 97 of variable thickness and the cap 92 acts against the cap 89 through a washer 98 of variable thickness.

Inside the barrel 90 is an armature 99. The core 93 has a first pole piece means 101 and the armature 99 has a second pole piece means 102. In this embodiment the first pole piece means 101 is partly on the core 93 and partly on the frame 86. The portion on the frame 86 is primarily the annular shoulder 88. The portion of the pole piece 101 which is on the core 93 includes an annular flat face 103, an annular shoulder 104, a cylindrical bore 105 and a flat face 106 at the bottom of this bore 105. The second pole piece means 102 on the armature 99 includes an annular flat face 107 having an annular shoulder 108, and a cylindrical extension 109 having a flat end face 110. The cylindrical extension 109 is closely receivable within the bore 105, within a few thousandths of an inch.

The sleeve 91 may be magnetic or non-magnetic. If magnetic, then the core 93 sleeve 91 and cap 92 may be unitary. If the sleeve 91 is non-magnetic, these parts may still be unitary with the sleeve or part of it heat treated, for example, to become non-magnetic while retaining the core 93 as magnetic. Alternatively, the sleeve 91 may be non-magnetic and merely soldered or welded to the core 93. If the sleeve 91 is magnetic then the thin cross-section thereof, for example 0.030 or 0.040 inches thick, will means that this sleeve readily becomes saturated during energization of the coil 12 so that it bypasses a minimum of flux from the armature 99.

In operation, the solenoid 85 of FIG. 6 acts in a manner similar to that of FIGS. 1–4. Assuming that the position shown in FIG. 6 is the first or extended position of the armature 99, then the second or closed position will be with the armature moved to the left until faces 107 and 103 are seated or faces 106 and 110 are seated. When the coil 12 is energized this exerts a force on the armature 99 to move it toward the left. The annular shoulder 104 and the annular shoulder at the junction of the cylindrical extension 109 and face 110 will be the first to become saturated. This is because of the minimum size of the flux carrying area. As these two shoulders begin to overlap, then the flux carrying area will increase in size and the saturation at this locale will begin to decrease and as shown above this will provide the force tending to move the armature 99 toward the left. Next the annular shoulder 108 and 88 will become saturated and as these shoulders begin to overlap the flux carrying area thereat will increase to decrease the saturation and again this will cause the leftward force on the armature 99. The curve 111 on FIG. 13 is a typical curve for the operation of the solenoid of FIG. 6. Comparing this curve 111 with the curve 66 of the prior art, one will note that curve 111 has two pronounced humps 112 and 113 where this stroke vs. force curve has decidedly been raised relative to the prior art. This means that the area under the curve is representative of the work which can be done by the armature 99. This first hump 112 occurs because of the saturation at the shoulder 104 and the second hump 113 occurs because of the saturation at the shoulder 88. The position of the hump 113 on the curve may be shifted to the right by making the washer 97 thicker and washer 98 thinner, while still retaining the same total thickness thereof. This permits the stroke vs. force curve to be tailored for different load applications.

Figure 7:
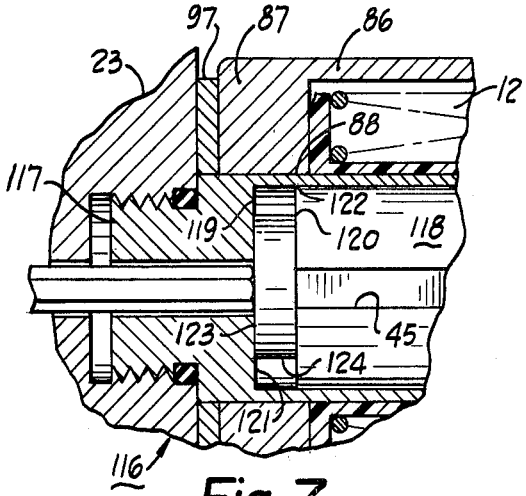

FIG. 7 shows a further modification of a solenoid 116 which includes a core 117 and an armature 118. The remaining parts of the solenoid may be the same as shown in FIG. 6. The frame 86 and core 117 has first pole piece means 119 which includes the annular shoulder 88 and a flat face 121 on the core 117. The armature 118 has second pole piece means 120 which includes an annular shoulder 122 and a flat face 123 on the end of a cylindrical extension 124.

The solenoid 116 of FIG. 7 is shown in the closed or second position with the armature face 123 in engagement with the core face 121. The first or extended position would be with the armature 118 to the right. When the coil 12 is energized this will exert a force to the left on the armature 118 and after a certain amount of movement the annular shoulders 88 and 122 will be closely adjacent. At this time this will be a flux carrying area which will be saturated by the flux established by the coil. As the armature 118 moves an increment of movement to the left so that these shoulders are overlapped, then the flux carrying area will become enlarged to decrease the saturation and this establishes the leftward force on the armature 118. FIG. 13 shows a curve 127 of the solenoid 116 of FIG. 7. This curve 127 has a hump 128 which increases the vertical height thereof above the prior art curve 66. This hump is caused by the saturation of the shoulders 122 and 88 at a certain segment of the stroke of the armature and this hump may be shifted to the right by making the washer 97 thicker, or shifted to the left by making this washer thinner.

Figure 8:
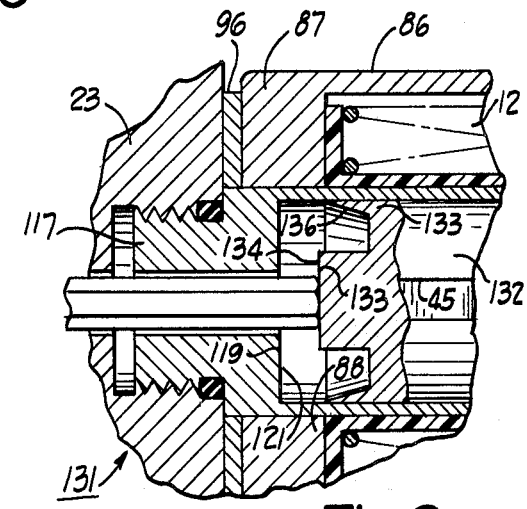

FIG. 8 is a partial view of a solenoid 131 which includes the core 117 and includes a modified armature 132. The core 117 has the first pole piece means 119 and the armature 132 has second pole piece means 133 which includes a flat face 134 on a central cylindrical extension 135 and includes a conical sleeve extension 136.

The solenoid 131 of FIG. 8 is shown in the first or extended position, moved away from engagement of the faces 121 and 134. The remainder of the solenoid may be that as shown in FIG. 6. When the coil 12 is energized there will be a leftward force on the armature 132. In the position shown there will be saturation of the annular shoulder 88 and the tip of the conical extension 136 on the second pole piece 133. As the armature 132 moves a small distance to the left, there will be a slight overlap of this shoulder 88 and tip of the cone. This will increase the size of the flux carrying area to decrease the amount of saturation and this causes the leftward force on the armature 132. Curve 137 on FIG. 13 illustrates the stroke vs. force curve for the solenoid 131 of FIG. 8. This curve 137 has a broad hump 138 which is caused by the saturable conical extension 136. In an actual solenoid manufactured in accordance with this invention and from which the curve 137 was obtained, the conical extension was a 30° angle relative to the axis and extended for a length of 0.075 inches from the base of the cone.

Figure 9:
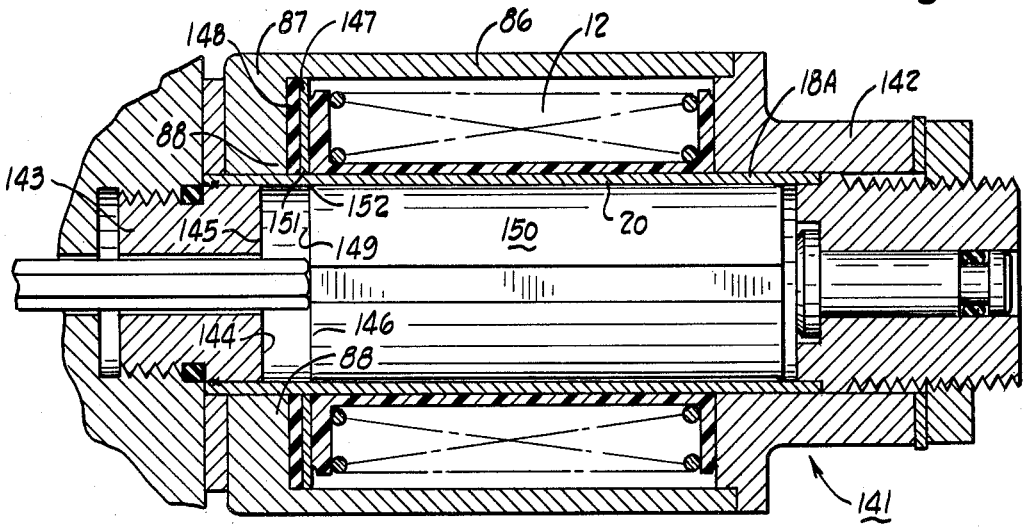

FIG. 9 illustrates a further embodiment of the invention of a solenoid 141 having the frame 86. A different end cap 142 is utilized as a part of the frame means and is secured in any suitable manner, such as by adhesive to the frame 86. The end cap 142 is of course of magnetically permeable material such as low carbon steel for ease and economy of fabrication. The solenoid 141 utilizes a barrel 18A quite similar to barrel 18 of FIG. 1 except with a different core 143. This core is of magnetically permeable material and forms a part of the frame means and has a flat end face 144 as a part of first pole piece means 145. The other part of the first pole piece means is the annular shoulder 88 on the frame 86. Still another part of the first pole piece means 145 is a magnetically permeable washer 147 spaced from the annular shoulder 88 by an insulator spacer washer 148.

Second pole piece means 146 is provided as a flat face 149 on an armature 150 which is slidable within the sleeve 20 of the barrel 18A.

The solenoid 141 of FIG. 9 is illustrated in the first or extended position and when the coil 12 is energized the magnetic flux urges the armature 150 toward the left. At about the position shown in FIG. 9 there will be a saturation of a part of the pole piece means 145 and 146. This saturation will occur primarily at the inner peripheral edge 151 of the permeable washer 147 and will occur at the annular shoulder 152 on the proximal end of the armature 150. This saturation of a flux carrying area of the pole piece means will decrease as the armature moves toward the left and this changing saturation provides the force on the armature. When the annular shoulder 152 comes in proximity with the annular shoulder 88, then this shoulder 88 will become saturated so that there is a saturation of a flux carrying area of the pole piece means throughout a definite segment of the range of positions of the armature 150. As the armature 150 moves still further toward the left, then this flux carrying area on the shoulder 88 will increase in size to decrease the saturation and continue the force on the armature 150.

Curve 154 in FIG. 13 is a curve of the force developed by an actual solenoid constructed in accordance with FIG. 9. This curve represents the force for a solenoid having a nonmagnetic tube 20 and with full wave bridge rectifier connected to energize the coil 12 with direct current from an alternating voltage source. Curve 155 is the same solenoid but energized with only half wave rectified energy from a single rectifier in series with the coil 12 plus a back diode connected across the coil.

Figure 10:
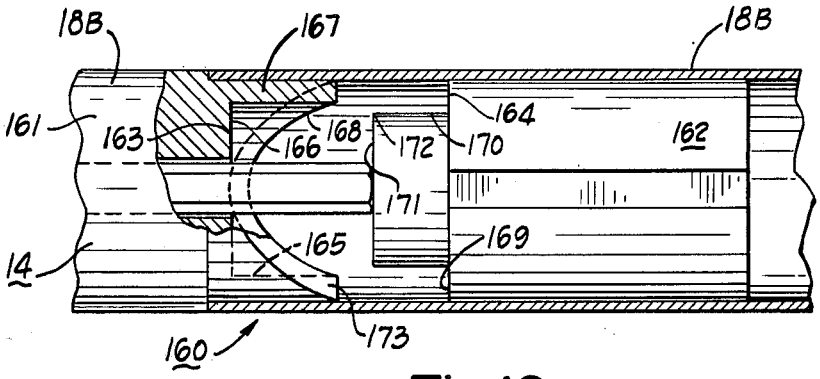
FIGS. 10 and 11 are top and side elevational views, partly in section, of a further modification.
Figure 11:
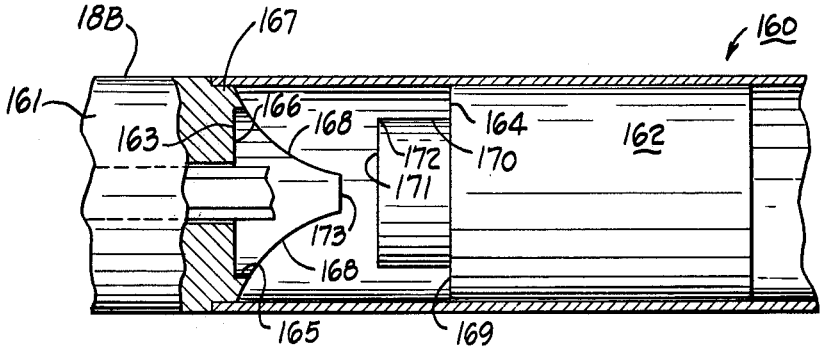

FIGS. 10 and 11 illustrate a further embodiment of a solenoid 160 and the frame means 14 may be the same as in the embodiment of FIGS. 1–4; namely, with the air gap between the pole pieces generally at the longitudinal center of the coil 12. A core 161 forms a part of the frame means 14 and coacts with the movable armature 162 within the barrel 18B. First pole piece means 163 on the core cooperates with second pole piece means 164 on the armature 162. The first pole piece means 163 includes a coaxial cylindrical bore 165 terminating in a flat face 166. As shown in FIGS. 10 and 11, the core 161, due to the bore 165, has a cylindrical extension 167 and this has been cut away on two arcs 168 to form a tapering saturable flux carrying area of the first pole piece means 163.

The armature 162 is somewhat similar to the armature 17 of FIG. 1, and the second pole piece means 164 includes a flat annular face 169, a cylindrical extension 170 and a flat face 171 on the end thereof defined by an annular shoulder 172. The cylindrical extension 167, because of the arcuate cutaway portions 168, is formed into two tapering extensions, the tips 173 of which will become saturated upon energization of the coil 12, along with saturation of the annular shoulder 172. The cylindrical extension 170 is closely received within the cylindrical bore 165 with a clearance of only a few thousandths of an inch. The area of the saturated flux carrying area gradually increases as the armature 162 moves toward the left to decrease the level of saturation and thus establish a continuing leftward force on this armature 162. Curve 175 on FIG. 13 illustrates an actual curve from a solenoid constructed in accordance with FIGS. 10 and 11. This curve shows a broad hump 176 which is caused by the gradually and smoothly changing saturation of the tapered cylindrical extensions 167. At the same time the saturable flux carrying area of the cylindrical extension 170 on armature 162 will gradually increase in size. This all helps produce the smooth curve 175 which lies well in excess of the force requirement curve 67 of the valve 23.

Figure 12:
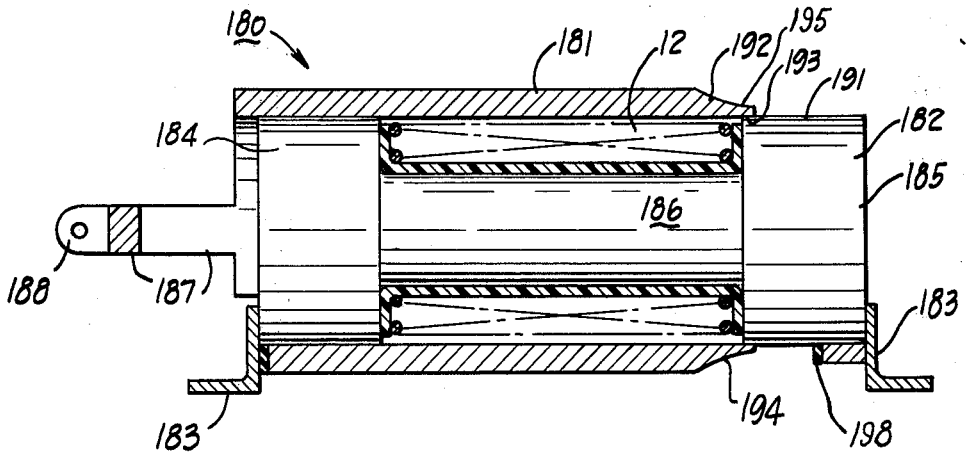
FIG. 12 is a longitudinal sectional view of another modification.

FIG. 12 illustrates another embodiment of a solenoid 180 embodying the invention. This solenoid shows an inside-out construction with a tubular coaxial armature 181 surrounding and movable along a fixed frame 182. Both the frame and armature are magnetically permeable and the frame 182 may be supported by L-shaped mounting brackets 183. The frame is circular in cross-section and includes enlarged cylindrical ends 184 and 185 and a reduced diameter central portion 186 on which the coil 12 is mounted. The solenoid 180 is shown as a pull type solenoid and a yoke 187 is connected to the left end of the armature 181 and carrier a clevis 188 for attachment to the applied load, not shown.

The frame 182 has a first pole piece means 191 and the armature 181 has second pole piece means 192. The first pole piece means 191 includes the cylindrical outer surface of the enlarged end 185 and especially an annular shoulder 193 adjacent the coil 12. The second pole piece means 192 is an arcuately tapering surface 194 on the right end of the cylindrical tubular armature 181. The very tip end of this arcuate surface 194 is the saturable flux carrying area of the pole piece 192 which is saturated upon energization of the coil 12. This tends to pull the armature 181 to the right, and the annular shoulder 193 is also a saturable flux carrying area on the first pole piece 191. As the armature 181 moves to the right and there is more overlap of the tip 195 and the annular shoulder 193, then the flux carrying areas on the two pole pieces become enlarged to decrease the amount of saturation, and this change of saturation is that which establishes the pull to the right on the armature 181. Curve 196 on FIG. 13 is a stroke vs. force curve of the solenoid 180 of FIG. 12.

The hump 197 in this curve 196 is created by the variable saturation of the second pole piece 192. If the stop 198 for the armature is moved to the left, then a curve 199 may be achieved, which establishes greater force at the closed position of the solenoid. If the stop 198 is moved still further to the left then a curve such as curve 200 may be achieved with still greater holding force in the closed position. None of these curves is of a solenoid designed for use with the valve which has the force vs. stroke curve 67. These curves 196, 199 and 200 are illustrative of how the force vs. stroke curve may be varied by moving the position of the stop 198.

The many embodiments of the invention illustrate new and practical solenoid configurations which not only can be reduced in size relative to the prior art designs but can yield solutions to basic problems inherent in the classical prior art solenoid with force developed by a variable air gap. The various solenoid embodiments of FIGS. 1–12 show that the stroke vs. force curve may be tailored to more closely approximate the force requirement curve of the applied load and therefore minimize the tendency of the prior art solenoids to destroy themselves because of the large impact shock that occurs upon seating of the armature. Typically in the prior art solenoid the force curve greatly exceeded the load curve. This originated from the fact that the classical solenoid curve shown in FIG. 66 has an inverse square shape whereas the load curve 67 is nearly straight. The excess energy, shown as the area between the two curves, is converted into kinetic energy of the armature and is dissipated upon impact.

The present solenoid designs utilize DC energization of the coil wherein the coil current remains constant independent of armature position. The prior art AC solenoids were ones wherein the coil current was often six times as high when the armature was not seated as when it was seated. This large current on the AC solenoid prior art coils created additional force and meant that the prior art DC solenoids were always larger than the prior art AC solenoids for equivalent force curves. A related problem with the prior art AC solenoids was that the coils would burn out when or if the armature was blocked and unable to seat. In the solenoids of the present invention a solenoid force curve may be shaped to match the load requirement and this greatly reduces the amount of excess energy which is converted to kinetic energy of the armature. This reduces the shock impact energy which must be dissipated by the solenoid mechanical structure, hence reducing the inclination for self-destruction and also reducing acoustic noise. Furthermore, a significant reduction in coil size and therefore overall size of the solenoid can result. For example, suppose that with a prior art design of solenoid approximately only half of the converted energy is necessary to be applied to the load. The other half is wasted. With the present invention the half that was formerly wasted would not have to be converted into kinetic energy. With all things remaining equal, this may mean a coil which produces only one-half of the former number of ampere turns. By simple analysis of DC circuits this means the coil would require only one-half the current, hence the coil power dissipation is only one-fourth of the former. Alternatively, the number of turns could be reduced by one-half, thereby reducing the coil length by a factor of two and the coil power could be reduced by a factor of two. Another alternative is to maintain the same coil power and thereby reduce the coil length.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and the scope of the invention as hereinafter claimed.

What is claimed is:

1. A solenoid comprising, in combination, a magnetically permeable frame means having an axis, a magnetically permeable movable armature coaxially disposed relative to said axis, first pole piece means on said frame means, second pole piece means on said armature cooperable with said first pole piece means, said armature having a first extended position with said first and second pole piece means separated from each other and having a second position with said first and second pole piece means relatively close together, and magnetic field saturation means firstly, to saturate a flux carrying area of one of said pole piece means in some segment of the range of positions of said armature, said saturation means including the pole piece means having shapes establishing secondly, a decrease in the saturation of said flux carrying area and a corresponding increase of flux at said saturated flux carrying area between said first and second pole piece means as the armature continues its movement toward said second position.

2. A solenoid as set forth in claim 1, wherein said saturation means includes an electrical coil establishing magnetic flux in said frame and armature, and means establishing substantially constant energization of said coil.

3. A solenoid as set forth in claim 1, wherein one of said pole piece means has an annular shoulder substantially perpendicular to said axis.

4. A solenoid as set forth in claim 1, wherein said saturation means includes the shape of said one of said pole piece means establishing an increase of said flux carrying area of said one pole piece means with armature movement toward said second position.

5. A solenoid as set forth in claim 1, wherein said saturation means includes an electrical coil establishing magnetic flux in said frame and armature.

6. A solenoid as set forth in claim 5, wherein said electrical coil is energizable with direct current through a rectifier from an alternating current source.

7. A solenoid as set forth in claim 6, wherein said frame means and said armature are of solid non-laminated construction.

8. A solenoid as set forth in claim 1, wherein said saturation means includes means establishing the shape of said pole piece means such that said flux carrying area increases to decrease the flux saturation thereof with armature movement from said first to said second position.

9. A solenoid as set forth in claim 1, wherein one of said pole piece means has a coaxial extension.

10. A solenoid as set forth in claim 1, wherein said flux carrying area is of smaller cross-sectional area than that of the main portion of said armature.

11. A solenoid as set forth in claim 1, including a barrel disposed coaxially relative to said frame means, means to seal said barrel except at one axial end, and said armature being disposed coaxially inside said barrel for axial movement.

12. A solenoid as set forth in claim 11, including a core mounted in a fixed position as part of one end of said barrel and acting as a magnetic flux carrier as part of said frame means in series with said armature, and part of said first pole piece means being on said core.

13. A solenoid as set forth in claim 12, wherein said barrel includes a non-magnetic sleeve coaxially sealed to one end of said core, and said core having a peripheral portion unencircled by said sleeve and being closely spaced to a portion of said frame means for efficient transfer of flux therebetween.

14. A solenoid as set forth in claim 1, wherein said pole piece means have cross-sectional shapes which are circular for easy machining.

15. A solenoid as set forth in claim 1, wherein said armature has a coaxial extension forming part of said second pole piece means.

16. A solenoid as set forth in claim 15, wherein said coaxial extension is cylindrical.

17. A solenoid as set forth in claim 1, wherein said second pole piece means has a coaxial extension substantially complementary to a coaxial relieved portion on said first pole piece means.

18. A solenoid as set forth in claim 17, wherein said first pole piece means has a coaxial central relieved portion substantially complementary to said coaxial extension on said second pole piece means, and an additional annular shoulder on said first pole piece means of a diameter larger than said armature.

19. A solenoid as set forth in claim 1, wherein said frame means has a coaxial sleeve extension as a part of said first pole piece means, and a plurality of segmented extensions longitudinally extending from said coaxial sleeve extension.

20. A solenoid as set forth in claim 1, wherein said second pole piece means has a coaxial central cylindrical extension from a flat annular face extending to the outer diameter of a cylindrical armature, and said first pole piece means has an annular shoulder of a diameter, larger than said armature.

21. A solenoid as set forth in claim 1, wherein one of said pole piece means has a conically tapered portion as said flux carrying area.

22. A solenoid as set forth in claim 21, wherein said one of said pole piece means includes a central coaxial cylindrical extension.

23. A solenoid as set forth in claim 21, wherein said armature is a sleeve member surrounding said frame means.

24. A solenoid as set forth in claim 1, wherein said second pole piece means is a flat substantially circular face on said armature of substantially the same diameter as the main portion of said armature.

25. A solenoid as set forth in claim 1, wherein said first pole piece means includes two partially cylindrical sleeve extensions with tapering surfaces.

26. A solenoid as set forth in claim 1, wherein said saturation means including the pole piece means having shapes so that said flux carrying area of said one pole piece means overlaps a second flux carrying area of the other of said pole piece means, and as said armature moves toward said second position said overlapping areas increase in area with substantially constant air gap at said overlapping areas.

* * * * *

UNITED STATES PATENT AND TRADEMARK OFFICE

CERTIFICATE OF CORRECTION

PATENT NO. : 4,166,991

DATED : September 4, 1979

INVENTOR(S) : Lambert Haner

It is certified that error appears in the above-identified patent and that said Letters Patent are hereby corrected as shown below:

The "Assignee" should read --Acme-Cleveland Corporation --

Column 3, line 60, delete "structure" and insert --aperture--.
Column 6, line 1, delete "block" and insert --blow--.

Signed and Sealed this

*Twenty-seventh* Day of *November 1979*

[SEAL]

*Attest:*

RUTH C. MASON
*Attesting Officer*

LUTRELLE F. PARKER
*Acting Commissioner of Patents and Trademarks*